US005383657A

United States Patent [19]

Rathmell

[11] Patent Number: 5,383,657

[45] Date of Patent: Jan. 24, 1995

[54] ELASTIC-POWERED CURVE-BALL HURLING DEVICE

[76] Inventor: Richard K. Rathmell, Rte. 4, Box 357B, Lexington, Va. 24450

[21] Appl. No.: 172,180

[22] Filed: Dec. 23, 1993

[51] Int. Cl.[6] ..... A63B 65/12; A63B 69/40; F41B 3/02

[52] U.S. Cl. ..... 273/26 D; 124/20.1

[58] Field of Search ..... 273/26 R, 26 D; 124/17, 124/20.1, 21, 26

[56] References Cited

U.S. PATENT DOCUMENTS

| | | | |
|---|---|---|---|
| 3,802,409 | 4/1974 | Mike et al. | 124/20.1 |
| 4,261,319 | 4/1981 | Dixon | 124/21 |
| 4,720,112 | 1/1988 | Stettner et al. | 273/411 |
| 5,123,643 | 6/1992 | Heilhecker et al. | 273/26 D |

*Primary Examiner*—William H. Grieb

[57] ABSTRACT

An improved device useful for hurling baseballs or the like to players in practice ball-hitting sessions has been developed. It provides multi-directional spin control to make a ball curve in any chosen direction from a normal trajectory path, as well as speed control, and it can be carried as a substantially lighter-weight and more easily portable package than the massive and expensive electric-powered curve-ball hurlers such as are now used by professional teams. The spin control is provided by attaching one end of a strap to the ball-holding pouch of an elastic-powered slingshot, or catapult, such that the loose end of the strap may be wrapped in any chosen direction around the ball as it is nested into the pouch, and the strap will induce a spinning motion on the ball when it flies out. The speed control is provided by a light-weight flexible cord that limits the length to which the elastic members of a slingshot may be stretched back; variable settings are possible. Weight reduction and easy portability is further improved by having a relatively thin and flat framework designed to hold the forward ends of the elastic members in a spaced-apart and elevated position, and having one or more relatively light-weight guy lines reaching forward from the framework to one or more suitable anchor points, such as stakes driven into the ground. The guy line(s) works in tension to resist the pull on the elastic members and hold the framework in a near vertical position.

8 Claims, 2 Drawing Sheets

ELASTIC-POWERED CURVE-BALL HURLING DEVICE

INTRODUCTORY BACKGROUND

This relates to a device to hurl baseballs or the like to a player during practice ball-hitting sessions.

It is known that skilled baseball pitchers normally put a controlled spin on almost every ball thrown, causing the ball to curve away from an otherwise normal trajectory, curving either up, down, or to either side, depending upon the direction of the spin. Skilled tennis players likewise hit the ball to make it spin and curve. Curve-balls are more difficult to hit in contests such as baseball games and tennis matches.

For baseball batting practice sessions there are electric-powered ball-throwing machines available which can be adjusted to throw curve balls at various set speeds, but these are relatively expensive and heavy to transport to a field for non-professional team practice, and electric power is generally not available at the pitcher's mound at most amateur practice sites. Electric-powered devices to hurl tennis balls are likewise available, but expensive and heavy.

Elastic-powered slingshots and catapults are well known, but none are known which provide multi-directional spin control. U.S. Pat. No. 5,123,643 describes a slingshot system capable of putting a spin on a baseball, but it is limited to a down-spin exclusively. U.S. Pat. No. 4,261,319 describes a slingshot for spinning a non-standard football out from a guide rod centered through the length of the ball, but this is clearly not applicable for baseballs, tennis balls, and the like.

It is the object of this invention to provide an easily portable, light-weight, non-electrical and relatively inexpensive device that has the ability to throw a baseball, tennis ball or the like with a controlled spin in any chosen spin direction, and with various settings for a controlled maximum forward velocity.

SUMMARY OF INVENTION

This will describe improvements to elastic-powered ball-hurling devices to provide: (1) the ability to make a spherical ball spin in any direction, (2) the ability to limit or control maximum hurling speed, and (3) improved light-weight portability.

A preferred system embodying these improvements includes the typical components of a slingshot, namely: 1-resilient elastic members which can be pulled back or elongated by a force and then released to accelerate and hurl a projectile, 2-a framework to hold the forward ends of the elastic members in a relatively fixed position when the slingshot is operated, and 3-a pouch attached to the rear, or loose ends, of the elastic members; this pouch serving to hold the projectile when the elastic members are stretched back and when they are released to accelerate the projectile, and then serving to release the accelerated projectile when the pouch decelerates.

For spin control, an important part of this invention is a novel pouch system. This pouch system includes a strap having one of its ends connected to the pouch, such that the rest of the strap may be wrapped in an optional direction around a ball as the ball is nested into the pouch. In operation, when the accelerated ball has gained momentum to fly out of the decelerating pouch, the strap can cause the ball to spin in a definite direction, either up, down, or sideways, depending on the direction the strap was wrapped around the ball and set into the pouch. It is possible, of course, to operate this slingshot without wrapping the strap around the ball, in which case the ball will be hurled without significant spin, equivalent to what a baseball pitcher calls a knuckle-ball.

For speed control, novel adjustable means have been developed to limit the stretch of the elastic, which in turn limits the force which can be accumulated in the elastic, the force to accelerate the ball, and the resulting speed of a standard-weight ball.

For easy portability and weight reduction, a flat framework has been made to hold the forward ends of the elastic members in an elevated and spaced-apart condition, improved by one or more light-weight guy lines to hold this framework in a relatively-fixed near-vertical position when forces are applied to the stretch the elastic and to hurl a ball at high speed.

Figure 1:
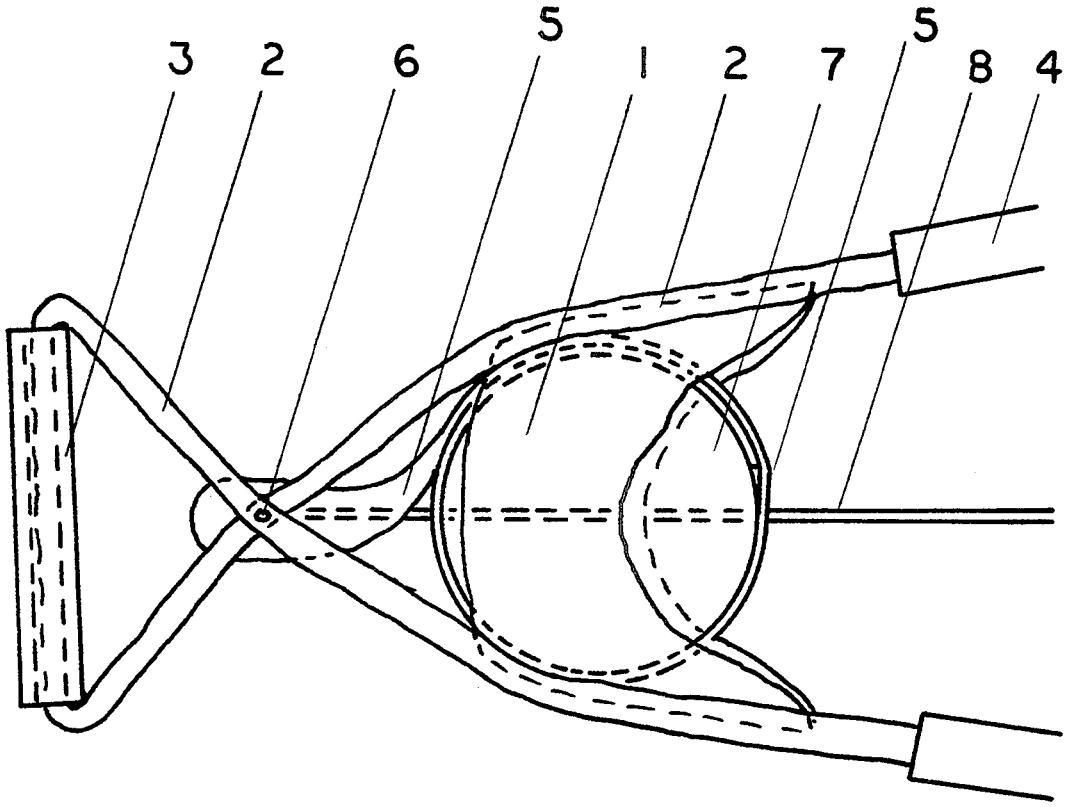
FIG. 1 illustrates one style of a pouch system made within the scope of this invention. It shows a soft-sided funnel-type pouch (1) with a strap (2) attached to the side edges of the pouch and extending back to a handle (3) and forward where it is attached to the elastic members (4). The important novel feature is the strap (5) with one end shown connected to the rear of the pouch system, at point (6), and with the loose end of this strap passing through the opening in the bottom of the funnel-type pouch, and wrapped around the ball (7) which is nested in the pouch. The edge view of the strap is shown around the ball in this particular view, but it should be understood that the ball could have been rotated as it was set into the pouch, such that we would then see a wide side of the strap, and in which case the ball would spin in a different direction when it flies out of the pouch.

To give assurance that a relatively husky operator cannot stretch the elastic to a point that the ball would be hurled at an excessive speed, a novel flexible stretch-limit/speed-limit cord (8) is shown with the back end attached to the pouch. The forward end of the cord, attached to the framework, is not visible in FIG. 1. The view in FIG. 1 shows part of the cord passing under the ball pouch and attached to point (6).

Figure 2:
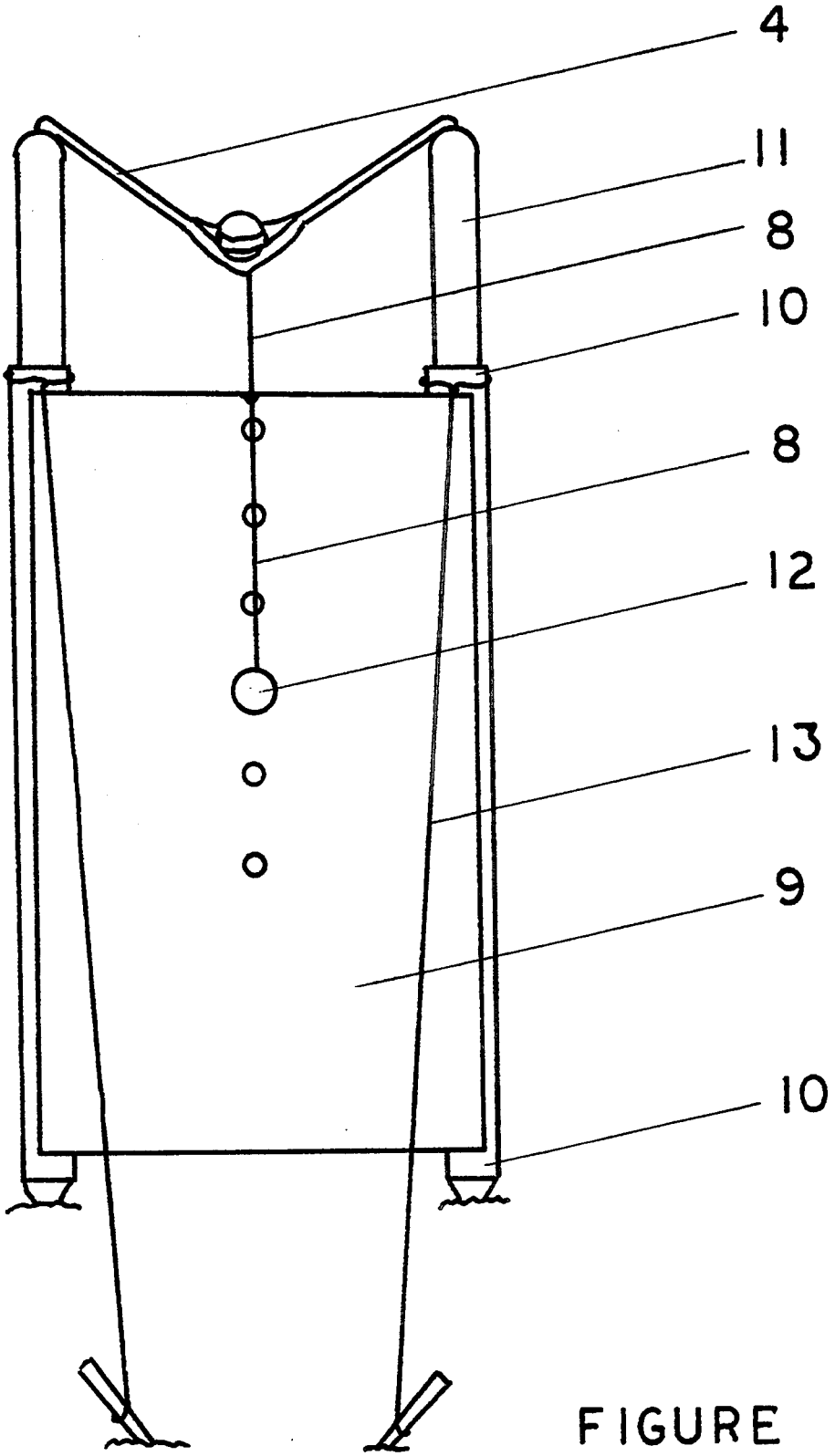

FIG. 2 illustrates a preferred type of flat framework as part of a light-weight, relatively small package that is easily portable to and from a practice site. This shows the front face of the framework, set up as a player to whom balls are hurled might see it, with the bottom corners resting on the ground. Shown is a rectangular panel (9) and two spaced apart rigid tubes (10) attached to the panel. Two rigid posts (11) having an outside diameter slightly less than the inside diameter of the tubes (10) are shown having been slipped into an operating position, and held there by conventional means, not shown. It is to be understood that the posts may be telescoped into the tubes, or removed, to make a shorter and more convenient package to carry. The forward ends of the elastic members (4) are attached to the tops of the posts which, in an operating mode, may be set to approximately the shoulder height of the slingshot operator, more or less. The novel stretch-limit/speed-limit flexible cord (8), which was identified in FIG. 1, is shown passing through a hole in the upper portion of the framework and having a latching device (12) on its forward end that is now hooked into the third hole from the bottom, not now visible behind the latching device.

It will be understood that when the cord is attached to the lowest of such holes or fastening spots the elastic members can be stretched back the least amount, and the ball will be limited to the lowest of the set speeds. However, when the cord is set at a higher spot the slingshot operator is not obligated to stretch the elastic to the cord's limit; just as a pitcher who is capable of throwing a very fast ball has the option of throwing a slower ball.

Important weight reduction for the portable package is achieved by the novel forward-extending guy lines (13) which reach from near the top of the frame to anchor points, such as stakes driven into the ground. It will be understood that the posts and panel preferably are guyed into a near vertical or rearwardly inclined plane, and that an additional guy, not visible in FIG. 2, may be used to prevent the panel from falling forward when no force is applied to the elastic members.

DETAILED DESCRIPTION

The novel strap in the pouch system preferably is long enough to partly overlap itself around the ball, to better grip the ball and impart a maximum spin on the ball, but a shorter strap may be used within the scope of this invention. It has been found that a shorter strap can still spin a baseball when the strap has been frictionized or treated such as with a rubber coating to make it grip the ball better. An all-rubber or elastic strap is also satisfactory. The strap preferably is between a half inch and one and a half inches wide simply to facilitate easy wrapping around the ball, but any wider or narrower strap could be utilized within the scope of this invention. The term "strap" should be broadly interpreted to include any flexible material which may have one end wrapped around a ball and cause the ball to rotate when the other end is pulled away. It could be a fish line, a cord, or a length of chain, but a length of ribbon or strap is preferred as the means to impart a spin on a ball.

The pouch need not be a soft-sided pouch as illustrated; rigid or semi-rigid cups, funnels or rings, may also be used with the novel strap somehow attached. The strap preferably is attached either to the bottom of the pouch or, as illustrated in FIG. 1, connected behind it to reach through an opening in the bottom of the pouch. The open bottom system has two advantages. One, it provides greater flexibility for orienting the direction of strap wrap when the ball is nested in the pouch. Two, for a powerful hurling device intended for baseballs or softballs, it can prevent smaller objects such as golf balls and small stones from being hurled at high velocity by an irresponsible operator. A rigid cup or semi-rigid ball-holding pouch is more appropriate than a soft-sided pouch for use with a catapult where the pouch is attached to a relatively rigid arm that is pivoted to swing and accelerate the ball.

The means to limit the stretch of the elastic members, which in turn limits the force accumulated in the elastic, and the speed of a standard weight ball, has been identified as including a "stretch-limit/speed-limit flexible cord". However, it should be understood that other flexible materials such as straps, chains, or the like, could be used within the scope of this invention. Preferably it will be relatively light weight, or have a low mass, compared to the weight (mass) of the pouch and elastic members, and be relatively flexible. It will have a means to adjust the limit the length of cord between the framework and the pouch system. With the back end of a fixed-length cord fastened to the pouch system, the forward end may be connected to any one of a number of fastening points on the framework. Different types of common latching devices and fastening points, other than holes as illustrated, may be used to set different stretch limits and speed limits. Other common means to shorten the length of cord behind the panel may be used, such as looping part of the forward end of the cord around alternative pegs. Preferably the means to adjust the stretch-limit of the elastic members should be visible to a person forward of the framework and thereby indicate to that person the potential maximum speed of a ball to be hurled.

The novel use of one or more guy lines is desirable for package weight reduction considering that a force of perhaps 150 pounds, more or less, may be applied to the elastic member to accelerate a standard baseball or softball to relatively high speed. Guy lines working in pure tension can weigh substantially less than equally strong structural members working in compression or to resist flexure or torque. The forward end(s) of the guy(s) may be attached to any suitable anchor, other than stakes in the ground, within the scope of this invention.

It should be obvious that other arrangements and configurations could be used within the scope of this invention.

I claim:

1. A device to hurl a ball, said device having a pouch system which holds the ball as it accelerates, and subsequently releases the ball when the momentum of the ball carries it out of the decelerating pouch, said pouch system having an attached strap such that the loose end of the strap may be wrapped around the ball as it is nested into the pouch, said strap providing means to induce a spinning motion on the ball as it flies out of the pouch.

2. A device as in claim 1 wherein the strap may be wrapped in any chosen direction around the ball as the ball is nested within the pouch.

3. A device as in claim 1 wherein the strap has a length sufficient to overlap itself around the circumference of the ball intended to be hurled.

4. A device as in claim 1 wherein the said strap has a length and a surface with a frictional characteristic sufficient to induce a spinning motion on a ball when the momentum of the ball carries it out of the pouch.

5. A device as in claim 1, wherein the pouch is funnel-shaped with an open bottom, or a ring, smaller than the diameter of a baseball, such that the strap may pass through it to wrap around a baseball, and objects such as golf balls and small stones may not be hurled.

6. A device as in claim 1, said device being a slingshot, having the pouch system attached to stretchable elastic members, a framework to hold the forward ends of the elastic members, a length of cord fastened to the pouch system and the framework, and means to adjust the length of cord between them to adjust the length to which the elastic members may be stretched, said means being visible to any person forward of the framework and thereby providing an indication of the potential speed of a ball to be hurled.

7. A device as in claim 1, said device being a slingshot having a pouch system connected to the rear ends of two stretchable elastic members, and the forward ends of these members are held in a spaced-apart and elevated position by a substantially flat framework having a bottom edge or legs resting on the ground, and the framework is held in its operating position by one or more guy lines extending forward to one or more anchor points.

8. A slingshot having a pouch attached to stretchable elastic members, a framework to hold the other ends of the elastic members, a length of cord fastened to the pouch and the framework, and means to adjust the length of cord between them to adjust the length to which the elastic members may be stretched.

* * * * *